US005740555A

United States Patent [19]

Renegar

[11] Patent Number: 5,740,555

[45] Date of Patent: Apr. 21, 1998

[54] GLOVE DESIGN FOR IMPROVED FIT AND UTILITY

[76] Inventor: Robert M. Renegar, 304 Black Bear Trail, Murfreesboro, Tenn. 37127

[21] Appl. No.: 759,344

[22] Filed: Dec. 3, 1996

[51] Int. Cl.[6] ..... A41D 19/00

[52] U.S. Cl. ..... 2/161.2; 2/161.1; 2/161.4; 2/917

[58] Field of Search ..... 2/159, 161.1, 161.2, 2/161.3, 161.4, 162, 161.8, 163, 169, 907, 16, 161.5, 161.6

[56] References Cited

U.S. PATENT DOCUMENTS

| | | | |
|---|---|---|---|
| 3,588,917 | 6/1971 | Antonious | 2/161.4 |
| 3,952,333 | 4/1976 | Fujita | 2/161.4 |
| 4,042,977 | 8/1977 | Antonious | 2/161.4 |
| 4,065,813 | 1/1978 | Hudson . | |
| 4,502,688 | 3/1985 | Papp | 2/161.4 |
| 4,658,445 | 4/1987 | Tribble | 2/163 |
| 4,691,388 | 9/1987 | Boone | 2/159 |
| 4,701,963 | 10/1987 | Overton . | |
| 5,004,227 | 4/1991 | Hoffman . | |
| 5,195,188 | 3/1993 | Bourdeau et al. . | |
| 5,197,149 | 3/1993 | Overton . | |
| 5,226,190 | 7/1993 | Lynch . | |
| 5,295,269 | 3/1994 | Ballard . | |
| 5,423,089 | 6/1995 | Chun et al. | 2/161.4 |
| 5,435,007 | 7/1995 | Kalvestran et al. . | |

*Primary Examiner*—C. D. Crowder
*Assistant Examiner*—Larry D. Worrell, Jr.

[57] ABSTRACT

A glove for sports and utility is provided with a method for creating multiple tensile forces along the length of the fingers and thumb and across the back of the hand through a point (30) of common force juncture located on the wrist proximate to the intersection of the base of the thumb and the wrist. These tensile forces yield continued improvement in fit and utility along multiple orientations of force lines across the back of the hand and along the fingers and thumb. These orientations of force lines are most advantageously aligned approximately perpendicular to the primary axis of closure of the human hand in grasping an object and the primary central axis of an elongated object being grasped.

Further, the fit in the finger enclosures and at the fingertips is significantly improved, as is the glove fit around the wrist and across the palm of the user's hand. These tensile forces continue to function properly and remain adjustable by the user throughout the life of the glove. The fit of this glove tightens and improves as the hand closes to grasp an object.

7 Claims, 11 Drawing Sheets

GLOVE DESIGN FOR IMPROVED FIT AND UTILITY

BACKGROUND—FIELD OF INVENTION

This invention relates to gloves used for sports and utility applications with means for improving their fit and usefulness.

BACKGROUND—DESCRIPTION OF RELATED ART

As special purpose glove applications have developed over time, many inventions have been created to improve the functional utility of these gloves. For most of these glove applications, continued proper fit through the useful life of the glove is imperative for maintaining maximum function, and yet fit persists as the largest single problem of special application gloves—particularly where leather is a primary construction material, and its stretch tends to compromise this all important fit. Moreover, for the great majority of sports and utility applications, the fingertip fit and finger usage are far more important considerations in utility than continued fit in the palm areas of the glove, yet prior art tends to address palm area fit almost exclusively.

The glove of U.S. Pat. No. 5,195,188 (1993) to Bourdeau et al. comprises tensioning means parallel to the primary axis of an object to be grasped, whereas, closure of the hand to grasp an object occurs perpendicular to this axis and would tend to create excess material looseness perpendicular to this axis. This patent also utilizes multiple tensioning means, however, the focal point of these multiple tensile forces is at the edge of the back of the hand adjacent to the little finger.

Further, Bourdeau's patent suggests the considerable advantage of adding elastic materials in the side panels of the glove's finger enclosures for improved and continued good fit around the fingers, yet overlooks the obvious need for maintaining the fingertip positions at the very end of the finger enclosures for maximum sensitivity in usage.

U.S. Pat. No. 5,195,188 (1995) to Kalvestran et al. describes a golfing glove with multiple tensioning means.

U.S. Pat. No. 5,226,190 (1993) to Lynch describes a baseball glove for sliding.

U.S. Pat. No. 4,065,813 (1978) to Hudson describes a baseball fielder's glove.

U.S. Pat. No. 5,197,149 (1993) to Overton describes an athletic glove for supporting the hand muscles during high stress activities.

SUMMARY OF THE INVENTION

In accordance with the present invention, a glove for improved fit and utility is provided comprising multiple tensioning means, directed toward a single advantageous point on top of the wrist near the base of the thumb's juncture with the wrist. This design yields the considerable advantage of tightening both the finger and palm areas of the glove perpendicular to the primary axis of an elongated object begin grasped.

The present invention is dedicated to creating properly oriented tensioning means for improved fit in the palm areas and the most important finger, thumb, and fingertip areas of a glove while maintaining continued fitting adjustability throughout the useful life of the glove.

Accordingly, several objects and advantages of my glove are:

(a) to provide a design for a sports and utility glove that will create fit improving tension approximately perpendicular to the primary axis around which an object is grasped by the human hand;

(b) to provide a means for locating these tensile forces at the most advantageous point on the hand of the human form;

(c) to provide a means for continued fitting adjustability throughout the life of a glove;

(d) to provide a means for continued excellent fitting despite the expected stretch of slightly extensible construction materials;

(e) to provide a design that actually tightens to fit better as the hand closes to grasp an object;

(f) to provide a means for ensuring that the fingertips stay effectively located at the ends of the glove's finger and thumb enclosures;

(g) to provide a design for improving the fit and utility of glove designs already consisting of many elastic panels in construction; and (h) to provide a design that would combat the natural stretching that occurs over the life of the glove as it is donned and removed repeatedly during usage.

Other objects and advantages will also become apparent from the drawings and specifications that follow.

BRIEF DESCRIPTION OF THE DRAWINGS

FIG. 2 illustrates the same parts as those in FIG. 1 except the axis Y is omitted and the palmar view is utilized.

Figure 1:
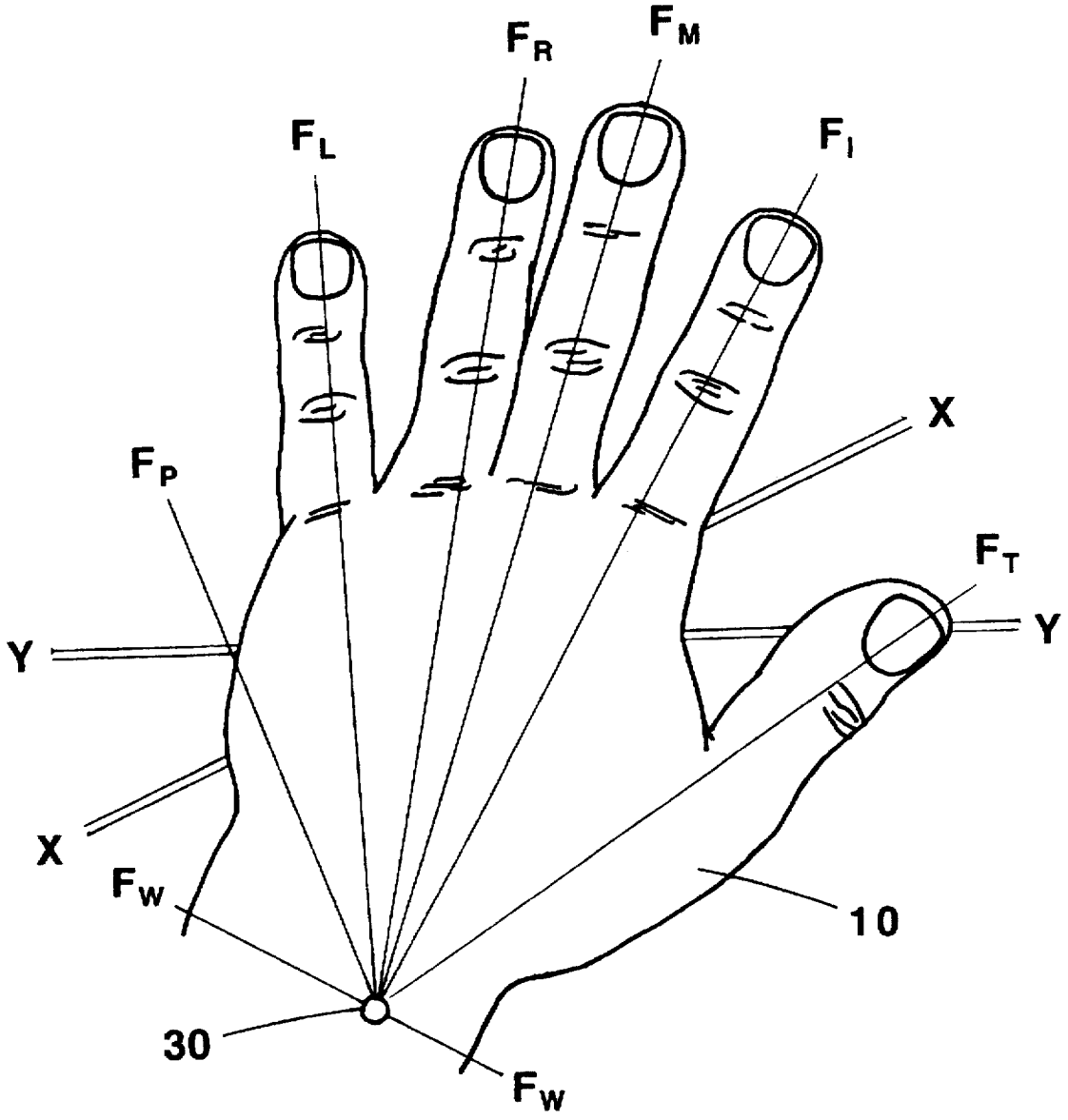
FIG. 1 is a perspective view of a human hand as viewed from above the back of the hand. An axis X and an axis Y of grasping orientations are illustrated. Also shown are a tensile force line $F_W$ across the wrist and a point 30. Extending from point 30 are a tensile force line $F_L$, a tensile force line $F_R$, a tensile force line $F_M$, and a tensile force line $F_I$ through the four fingers. A tensile force line $F_T$ extends from point 30 through the thumb, and a tensile force line $F_P$ extends from point 30 through the edge of the palm area adjacent to the little finger.

Reference Numerals In Drawings 10 glove $F_T$ tensile force line along thumb

12 back panel $F_I$ tensile force line along index finger

14 anchored strap segment $F_M$ tensile force line along middle finger

16 loop fastener $F_R$ tensile force line along ring finger

18 slit opening $F_L$ tensile force line along little finger

20 strap end segment $F_W$ transverse tensile force line at wrist 22 hook fastener $F_P$ palmar transverse tensile force line 24 elastic strap segment X linear usage orientation axis 26 reversing slider anchor Y transverse usage orientation axis 28 palm pad reinforcement (optional)

30 point of common force juncture

Description—FIGS. 1 to 9

Figure 2:
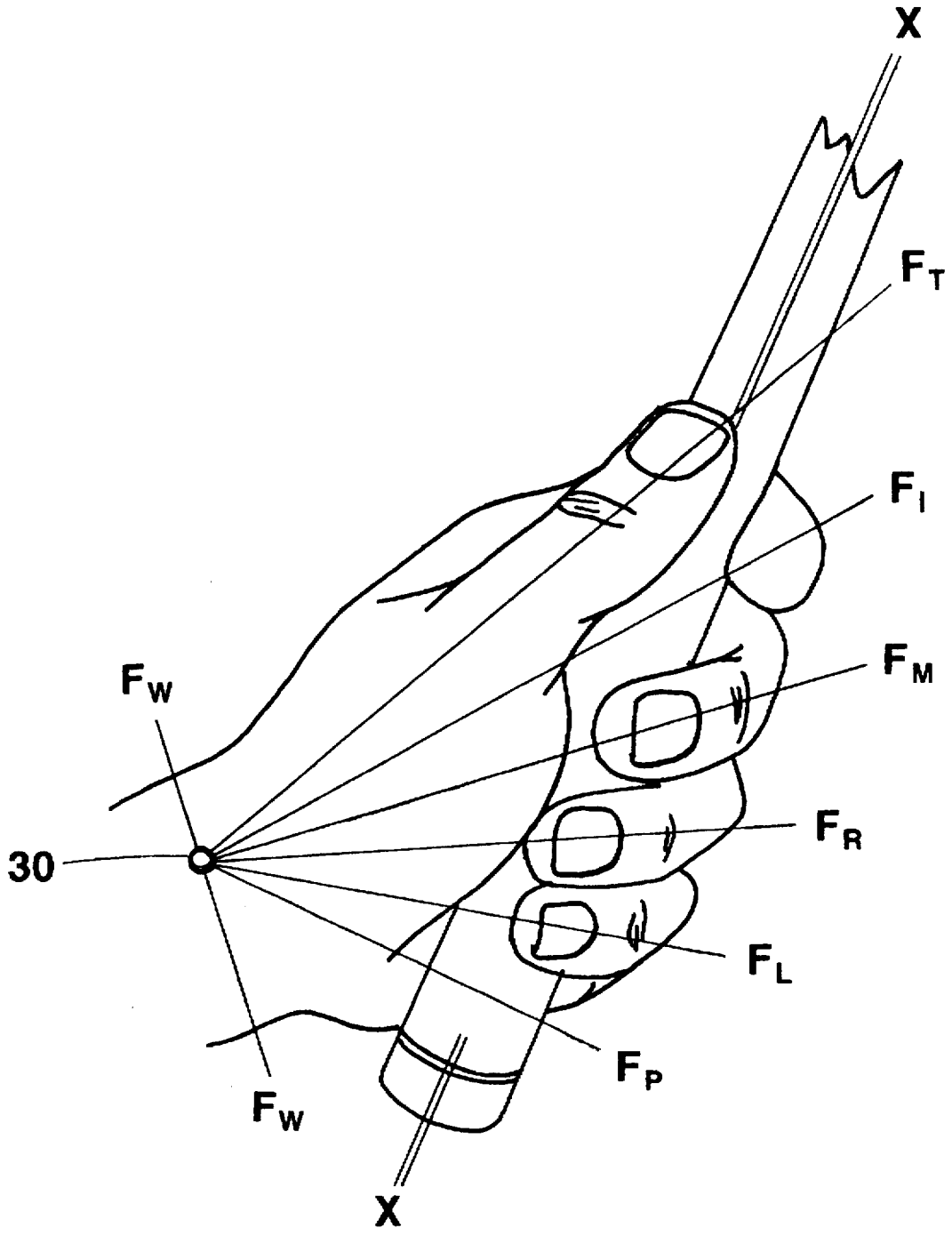
FIG. 2 is a perspective view from the underside of a human hand that is closed into the grasping function along the axis X orientation.

FIGS. 1 and 2 illustrate various aspects of the design of the present invention. FIG. 1 perspective view shows an axis X and an axis Y indicating the normal axes of orientation for an object grasped by the human hand. Axis X is more linear and consistent with the gripping orientation associated with a golf club grip or racquet sports grip. The axis Y is more transverse and illustrates better an orientation consistent with gripping a baseball bat or ski handle or weight-lifting bar. Tensile force lines $F_P$, $F_L$, $F_R$, $F_M$, $F_I$, $F_T$, and a force line $F_w$ illustrate the many orientations of the tensile forces provided by this glove design. An intended point 30 of common force juncture is illustrated along force line $F_W$ on the top of the wrist approximately 0.75 inches from the juncture formed by the base of the thumb and wrist.

Figure 3A:
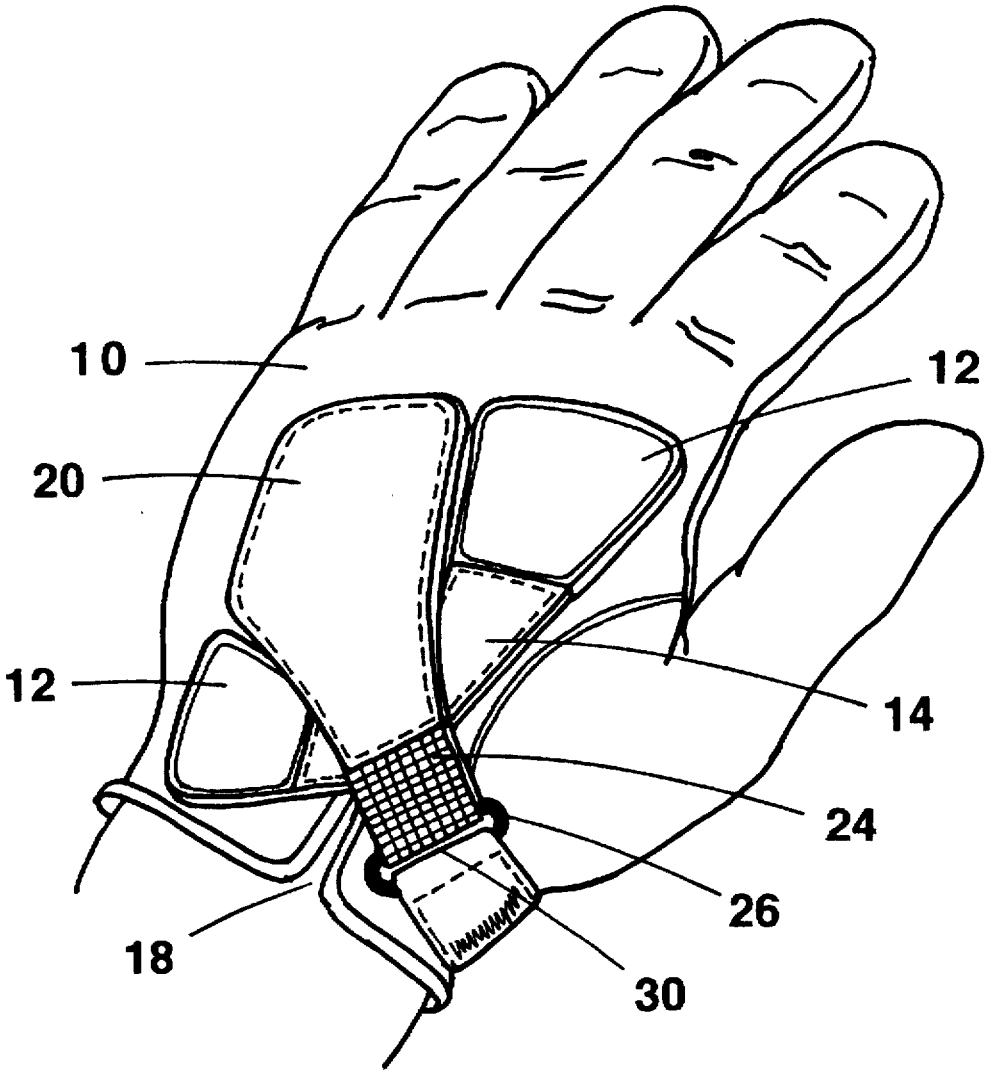
FIG. 3A illustrates the preferred embodiment of the sports and utility glove with a majority of the glove parts numbered.
Figure 3B:
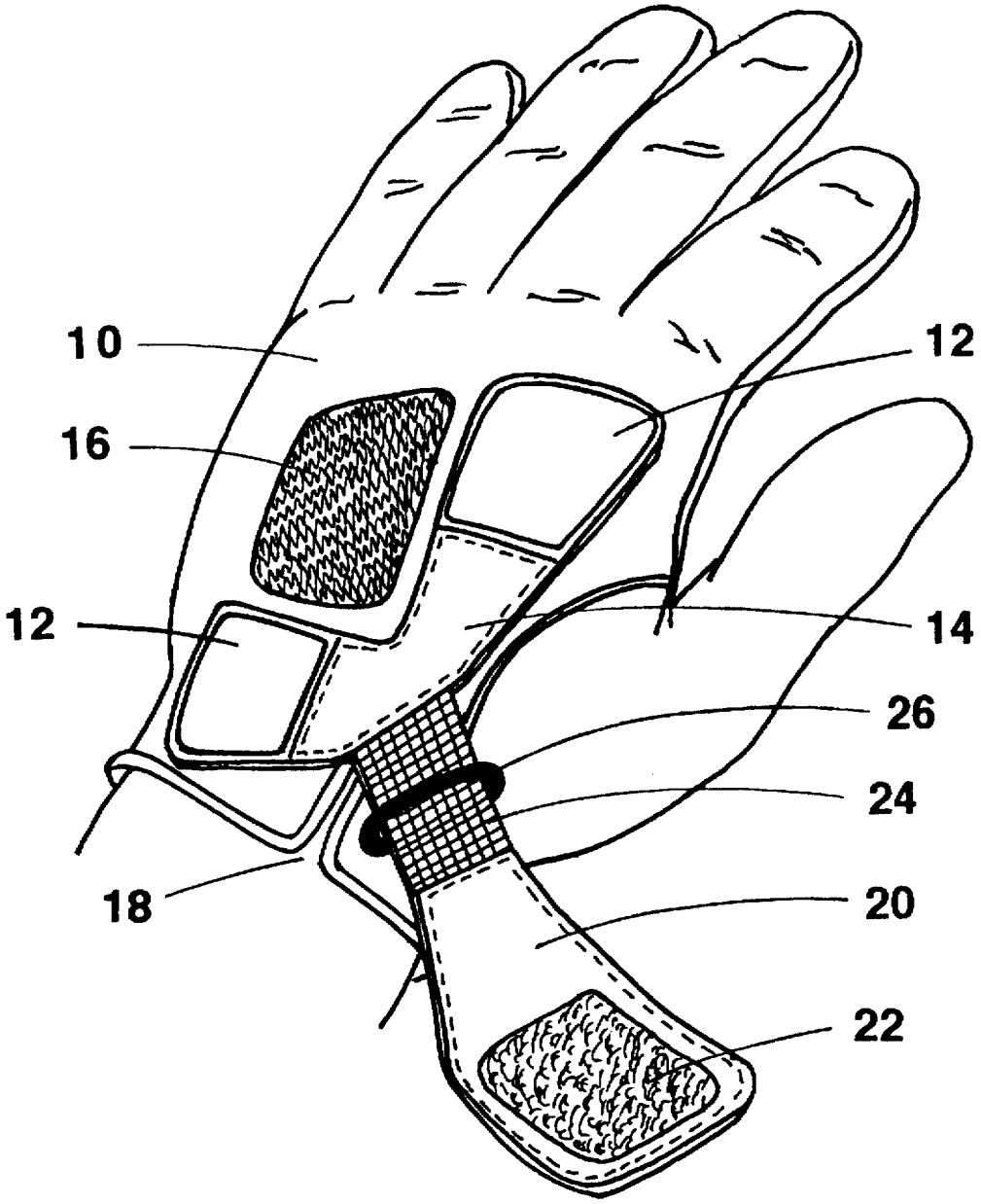
FIG. 3B illustrates the same preferred embodiment with the glove closure opened to expose and illustrate additional important parts.

FIG. 3A and 3B illustrate the several detail parts of the present invention. A glove 10 may be constructed from any of many materials and material combinations common to glove manufacture today, including leather, synthetics, and elastic materials. A back panel 12 is part of the back of the hand portion of the glove. Panel 12 may vary in shape and size, and may be constructed of extensible elastic materials or may be constructed of non-extensible material. There may be more than one panel 12. An anchored strap segment 14 is attached to panel 12 by sewn connection or other similar permanent means. Segment 14 may or may not be made from an elastic material. The preferred embodiment would have segment 14 constructed from some non-elastic material—preferably a molded material or leather. Segment 14 is connected to an elastic strap segment 24 by sewing, cement, or other permanent means. Segment 24 is likely made from some elastic material. Segment 24 is permanently connected to a strap end segment 20. End segment 20 is preferably constructed from some non-elastic material like leather.

End segment 20 has a hook fastener 22 of a common hook and loop closure attached to its under surface when closed over the wrist. Glove 10 has an appropriately matching loop fastener 16 attached to the back of the hand. The entire strap construction with parts 14, 24, 22, and 20 remains inserted through a slider anchor 26 for normal usage. Slider anchor 26 is permanently attached to the glove at point 30. A slit opening 18 is provided to afford ease of doffing or donning the glove.

Figure 3C:
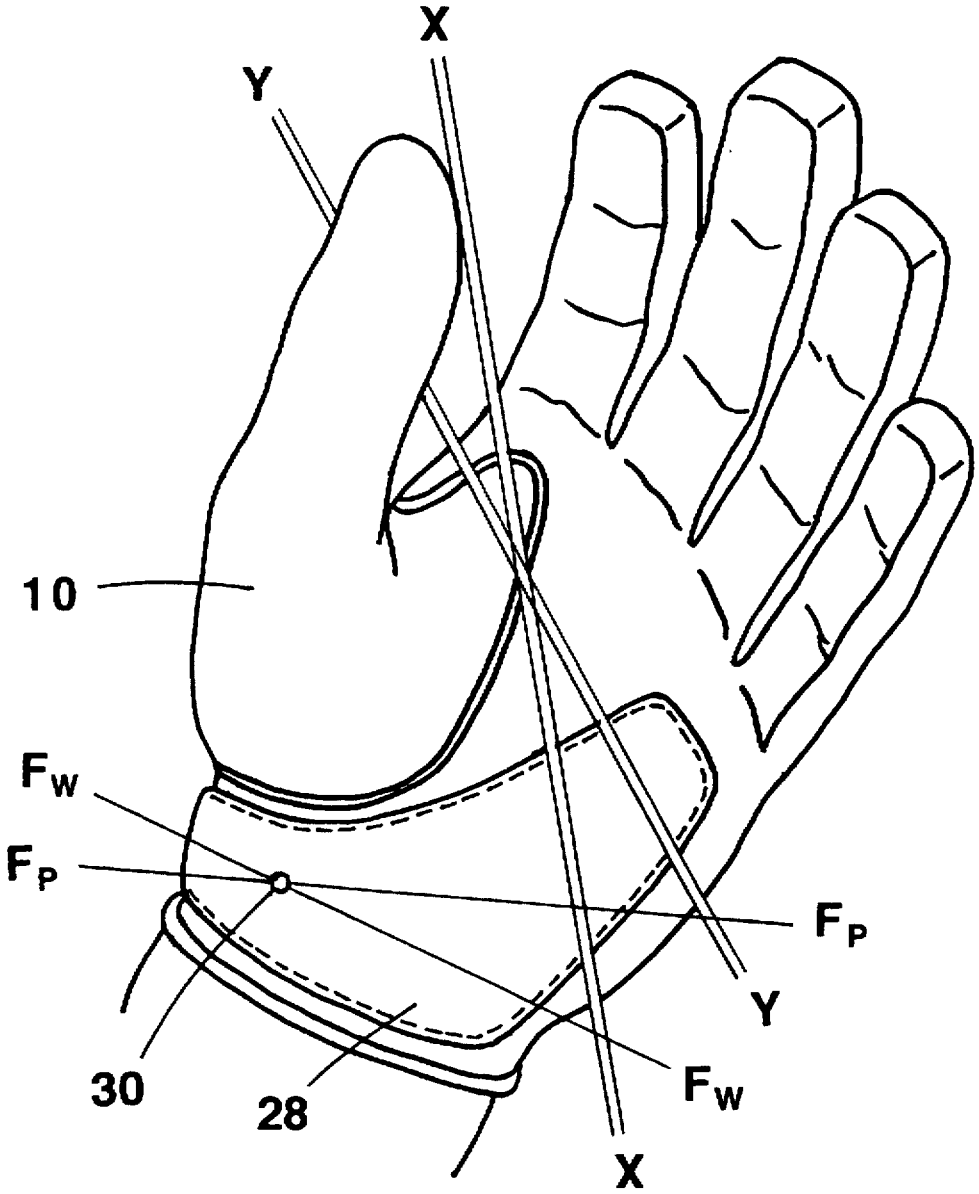
FIG. 3C shows a palmar view of the preferred embodiment.

FIG. 3C illustrates the preferred embodiment in a perspective view from the underside of the hand, a palm view. Point 30 is again illustrated as the focal point of underside tensile force line $F_W$ and a force line $F_P$. An optional palm pad reinforcement 28 is illustrated as it may be added to the preferred embodiment as an elastic or non-elastic panel attached to the base of the palm area.

Figure 4:
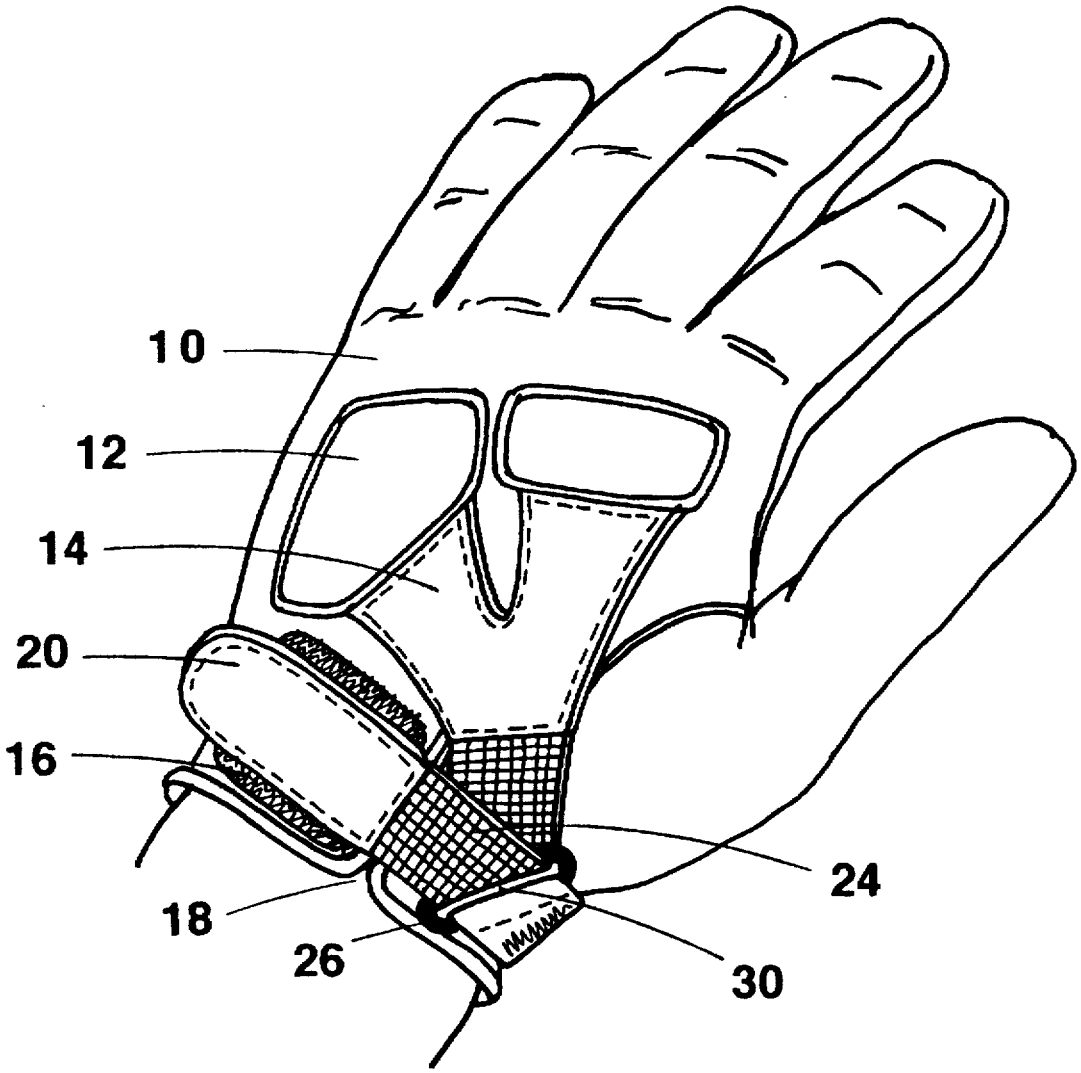
FIG. 4 shows an alternative embodiment of this invention.

FIG. 4 shows an alternative embodiment of the present invention that has panel 12 location reversed with the strap closure location.

Figure 5:
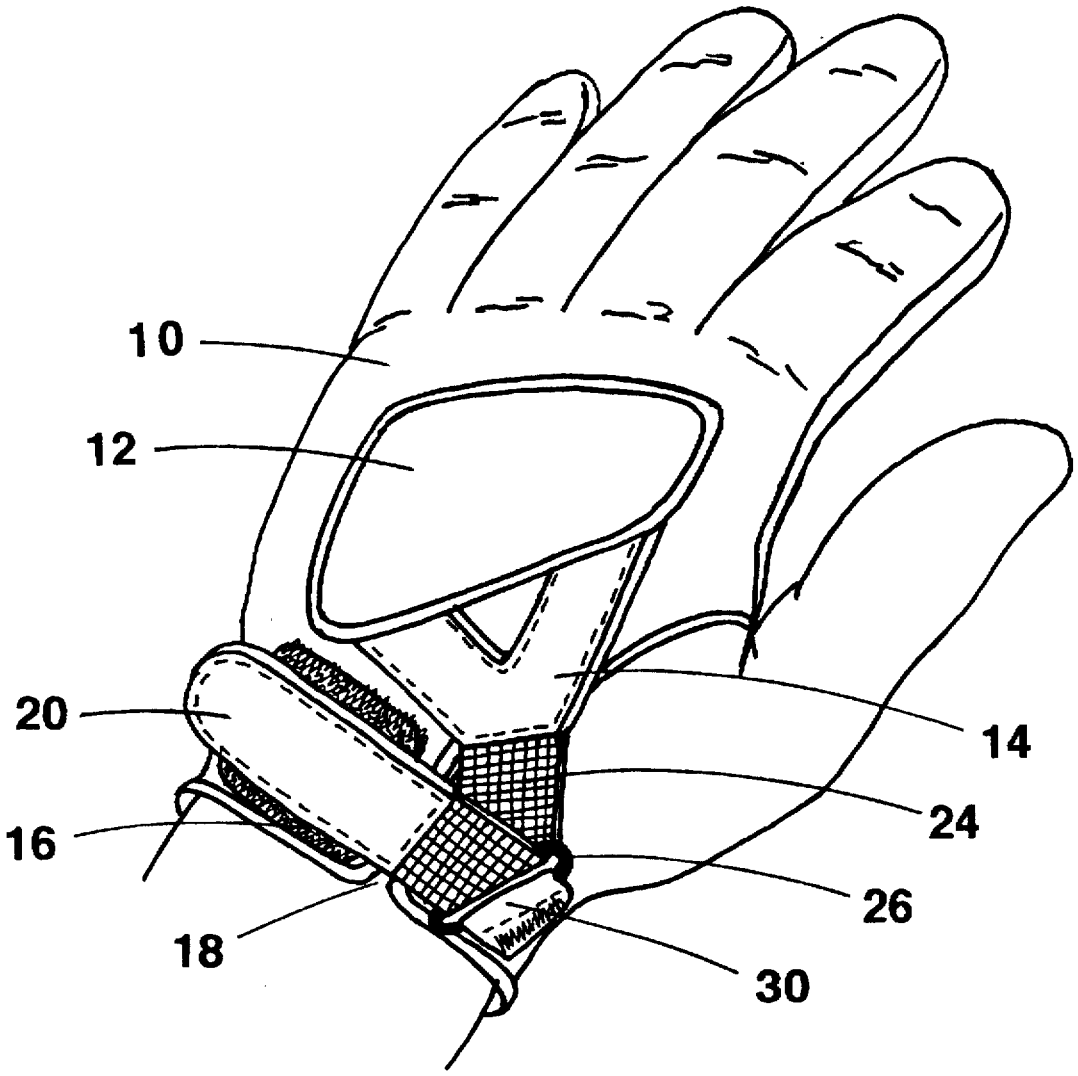
FIG. 5 shows an alternative embodiment of this invention.

FIG. 5 illustrates an alternative embodiment with different strapping construction and configuration.

Figure 6:
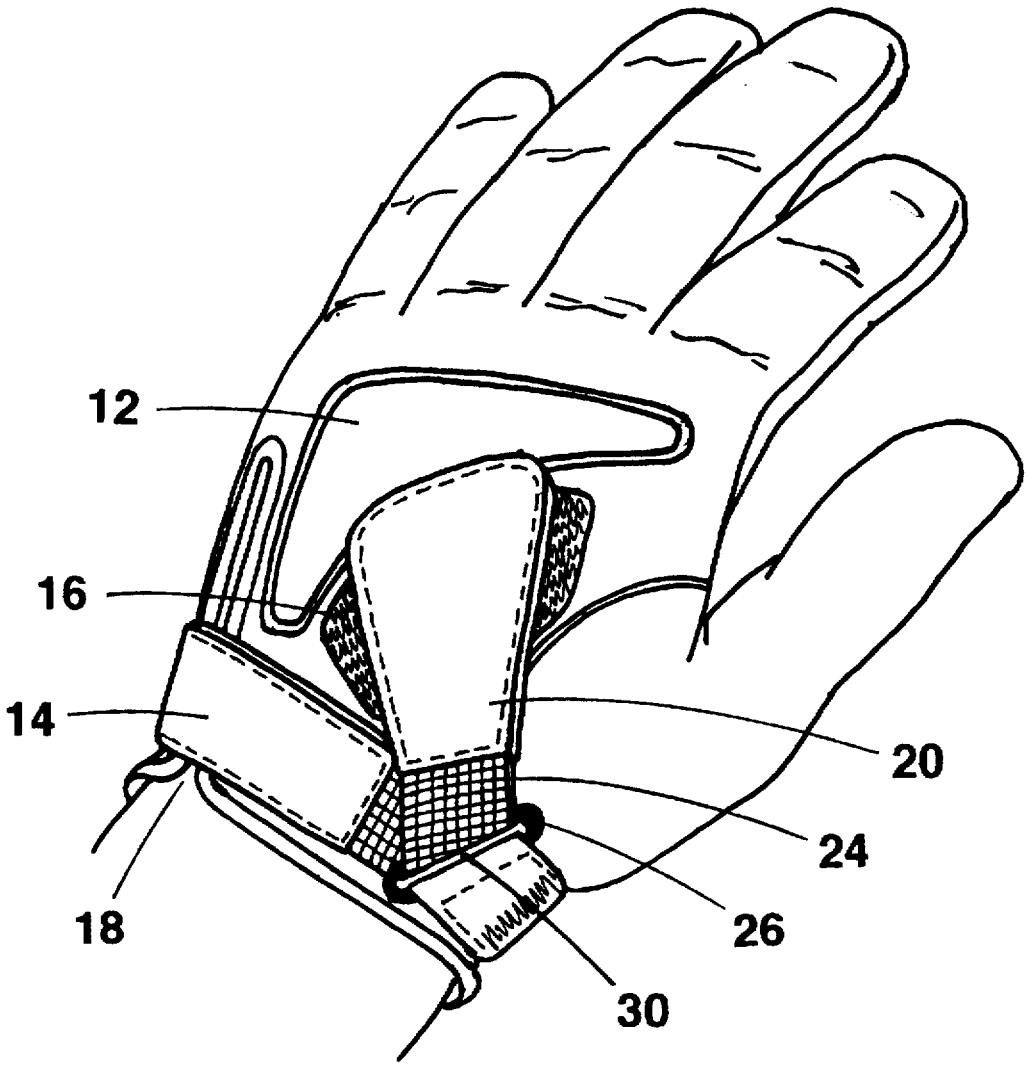
FIG. 6 shows an alternative embodiment of this invention.

FIG. 6 illustrates yet another possible embodiment with a slit opening 18 located differently and a strapping arrangement that is different in its anchor and closure locations from the preferred embodiment.

Figure 7:
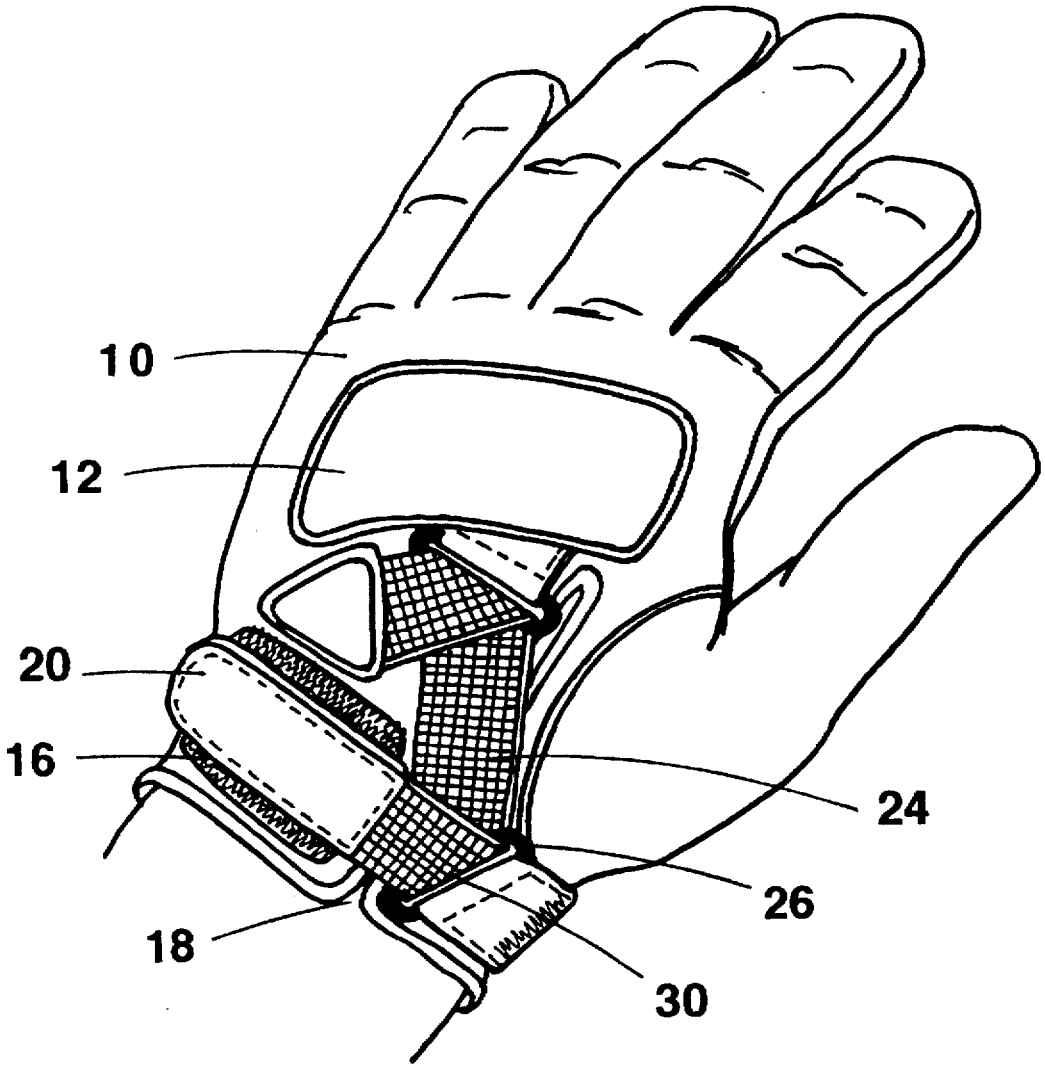
FIG. 7 shows an alternative embodiment of this invention.

FIG. 7 shows a construction similar to the FIG. 5 embodiment with the addition of a second reversing anchor slider and an additional tensile force in an additional orientation.

Figure 8:
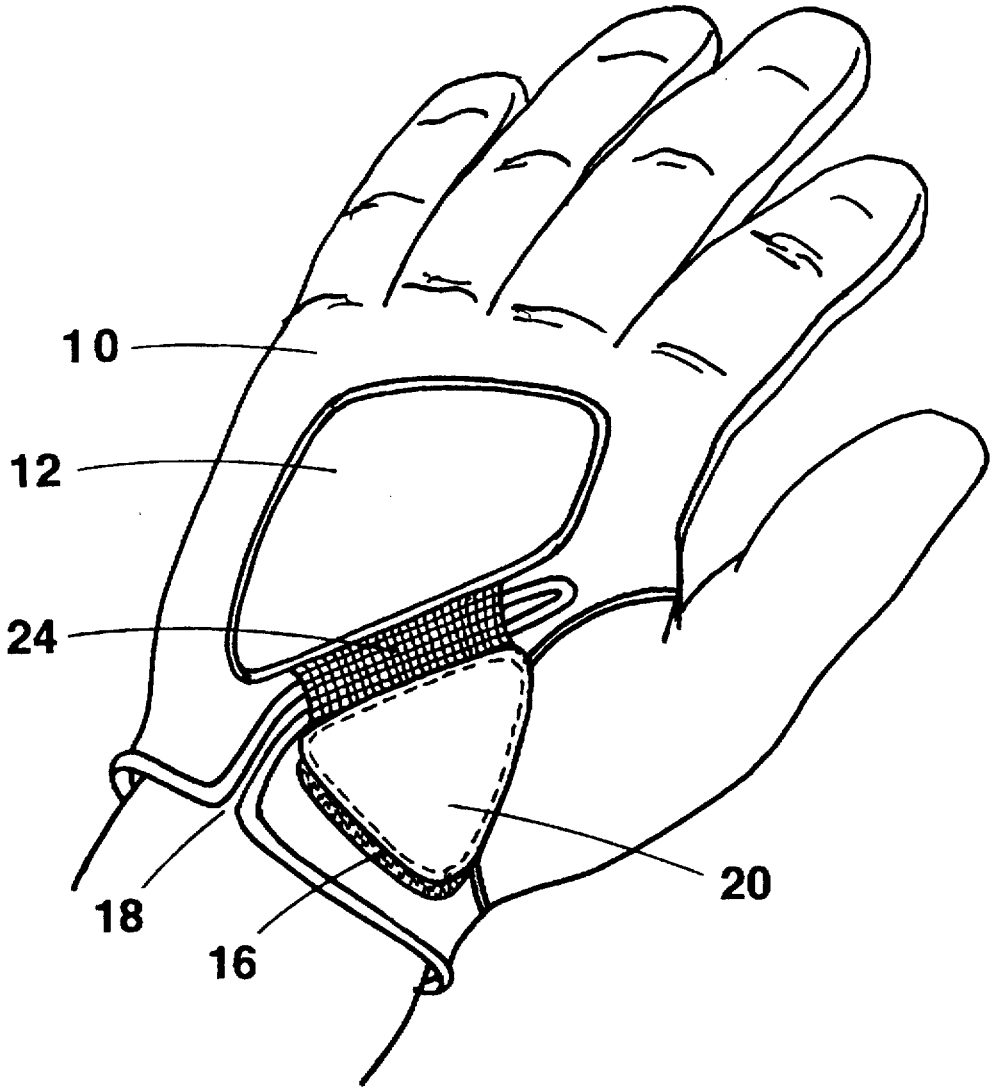
FIG. 8 shows an alternative embodiment of this invention.

FIG. 8 illustrates a simplified alternative embodiment with a single resultant tensile force arrangement also oriented proximate to point 30.

Figure 9:
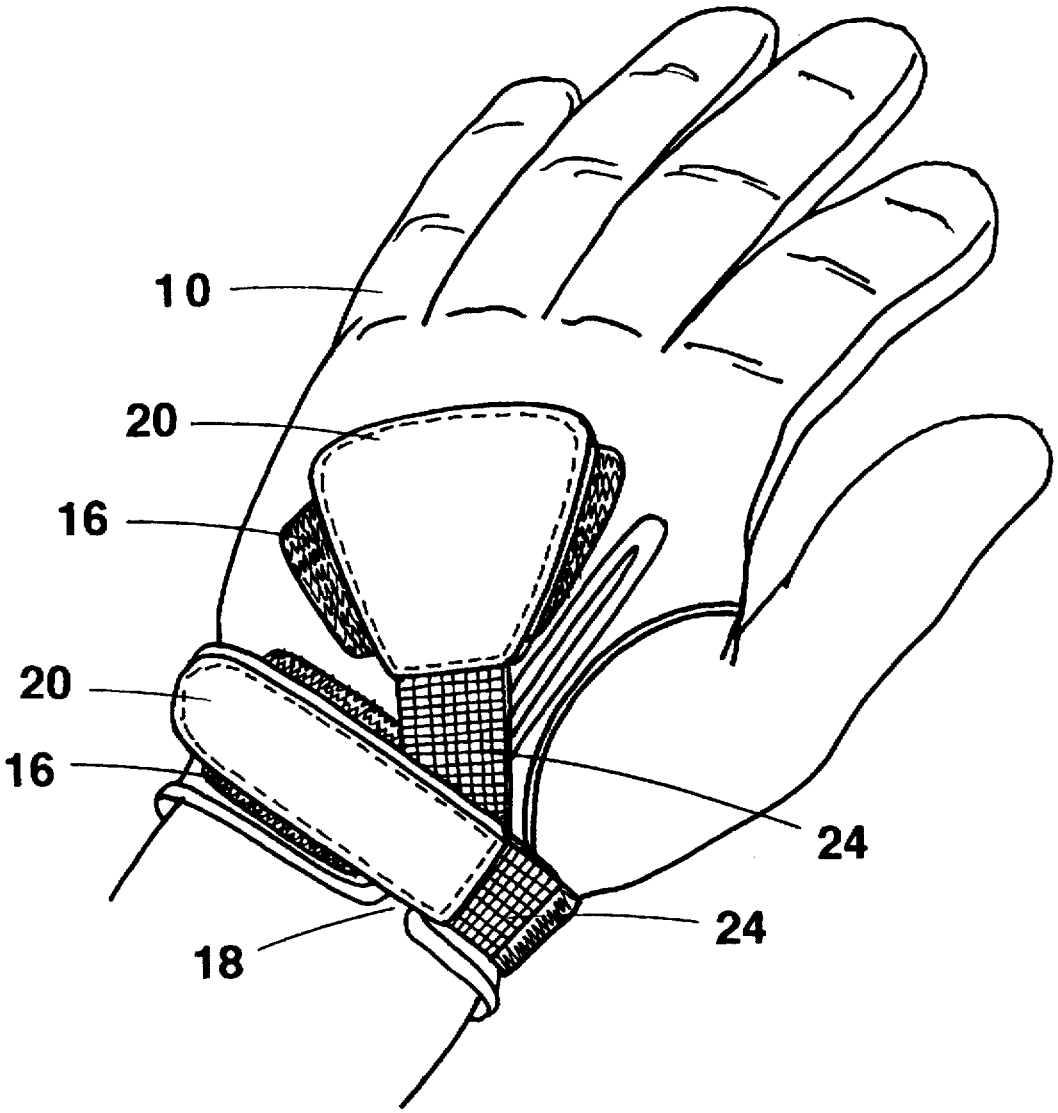
FIG. 9 shows an alternative embodiment of this invention.

FIG. 9 illustrates an alternative embodiment with multiple straps and multiple closure locations and does not include a reversing anchor.

DESCRIPTION OF THE PREFERRED EMBODIMENTS

The method of operation for all figures of the invention may be described in many common respects as these embodiments are intended to be similar variations of the same design.

All of these embodiments recognize that as the grasping action is accomplished by the human hand, the fingers normally close around an object and across the palm approximately toward the point 30 juncture. The orientation of this grasping motion may vary according to what object is being grasped and what utility this grasped object will accomplish. Axes X and Y in FIG. 1 illustrate a normal range of this orientation from more linear to more transverse.

The protuberance of the thumb originates near the point 30 juncture. This point 30 is unique in that it is on the minimum circumference at the wrist, that it is located in a plane perpendicular to the primary axis of objects being grasped, and that it is approximately the focal point of the fingers and thumb orientation as they are extended in an opened hand and as they are closed in the grasping motion.

The glove of the present invention uniquely takes advantage of the thumb protuberance, this minimum circumference, and the point 30 area to gather and anchor tensile forces across the palm and the back of the hand, along the length of the fingers, and around the wrist to improve fit and utility for the glove through the point 30.

The back panels 12 in FIGS. 3A and 3B create a broad surface area across the back of the hand from which multiple tensile forces are collected and permanently anchored for the purpose of generating tensile forces along the length of all the fingers and across the palm area. The anchored strap segment 14 gathers, transfers, and directs these collected multiple tensile forces to the elastic strap segment 24 and strap end segment 20 through the slider anchor 26 at point 30.

After the glove is donned in a manner consistent with donning any other normal glove as illustrated in FIG. 3B, the user will apply a comfortable tensile force with his other hand to the strap assembly obliquely across the back of the hand away from the loop fastener 16. Once a comfortable tensile force is established, it is maintained while the user redirects the strap assembly across the back of the hand as illustrated in FIG. 3A to accomplish a normal closure at loop fastener 16. Elastic strap segment 24 should preserve a suitable portion of the fitting tensile forces illustrated in FIG. 1. Once the glove closure has been accomplished, simultaneous tensile forces for improved fit will have been produced in the many orientations illustrated in FIG. 1.

After the glove has been donned and the closure accomplished, the motion required to grasp an object will tighten and improve the fingers, thumb, and palm fit. If other optional elastic panels are included in the construction of an alternative embodiment, then additional tensile fitting forces would be present.

Further, FIG. 3C illustrates how tensile force $F_W$ extends around the wrist and across the bottom of the hand creating force line $F_P$ across the palm.

FIG. 4 operates similarly to the preferred embodiment with the exception that the back panel 12 location and the closure location are exchanged.

FIG. 5 accomplishes the present invention in an alternative embodiment by exchanging positions of the strap closure and one of the strap permanent anchor points. Additionally, a single larger back panel 12 has been utilized.

FIG. 6 illustrates an alternative embodiment whereby the strapping means has been permanently anchored alternatively at the edge of the wrist opposite the thumb and with the hook and loop closure moved into the back of the gloved hand approximately along force line $F_R$. Also the slit opening 18 has been relocated to an area immediately adjacent to the new permanent anchor strap position.

FIG. 7 shows an alternative embodiment with the addition of another tensile force not oriented through point 30 and a second reversing slider assembly.

FIG. 8 illustrates a simplified configuration of the present invention showing a single resultant of multiple tensile forces arrangement oriented along force line $F_R$ and aligned toward the area of point 30. A revised orientation and location of slit opening 18 are provided. A multiple strapping arrangement with a reversing anchor slider is not used, however, the finger and palm area fit enhancements continue to be effective. The user of the FIG. 8 embodiment would don the glove normally and create tensileforce with the opposite hand approximately along force line $F_R$ and toward the point 30 area. Once a comfortable level of tension is created for fit enhancement, a normal hook and loop closure is accomplished.

FIG. 9 operates differently from all other embodiments in that it has two straps and two closures. The wrist strap closure along force line $F_W$ would be accomplished first, and then the second closure would be accomplished across the back of the hand with a comfortable tensile force toward the second closure.

Accordingly, the reader will have observed from the foregoing that the sports and utility glove of the present invention has the additional advantages of the following:

- the multiple tensile forces are provided essentially to improve palm fit in a "U"-shaped orientation across the back of the hand along the several force lines $F_P$, $F_L$, and $F_R$ through point 30 and across the palm underside of the hand along force line $F_P$;
- the tensile forces along force line $F_W$ secure the wrist fit and further anchor forces along all force lines by securing the location of point 30 in its approximate area;
- the tensile force $F_W$ also provides for pulling the glove's thumb enclosure toward the wrist to position the tip of the thumb nearer to the tip of the thumb enclosure;
- the forces along lines $F_L$, $F_R$, $F_M$, and $F_I$ provide tensile forces toward point 30 to pull down on the finger enclosures and enable a finger tip location at the end of the finger enclosures;
- the fit of this glove design actually tightens and improves as the hand is closed normally to grasp an object;
- the fit of this glove is adjustable, allowing for greater flexibility to its user and greater latitude to manufacturer with regard to fitting precision; and
- the fit of this glove remains good through the normal life of the glove despite the expected stretch of many glove types and materials.

Although the description above contains many specificities, these should not be construed as limiting the scope of the invention, but as merely providing illustrations of some of the presently preferred embodiments of this invention. For example, all or portions of the glove may be elastic materials or may contain elastic material panels in advantageous locations.

The slit opening location might be altered to any of several other possible locations. It might even be eliminated altogether and replaced with elastic panels or perhaps excess material in this area might simply be gathered and folded under strapping.

Alternative strapping means and locations might be employed, and these strapping means may range from completely constructed from elastic materials to constructed totally from non-elastic materials. Natural materials might be utilized or synthetic materials might be utilized or some combination thereof. The strapping means might even be eliminated altogether and the tensile forces produced by specifically positioned and aligned elastic panels or components.

Thus the scope of the invention should be determined by the appended claims and their legal equivalents, rather than by the examples given.

I claim:

1. A glove for sports and utility comprising a palm having a proximal region and a distal region, a back having a proximal region and a distal region, individual finger portions each having a base, a thumb portion having a base, and a wrist portion; said wrist portion joining the base of the thumb portion at a point of juncture; said glove further comprising an adjustable tensioning means; said tensioning means including a Y-shaped strap member extending obliquely from the distal region of the back portion, across the proximal region of the back portion, to the point of juncture, said strap means providing at least one primary tensile force disposed obliquely along a line across the back of said glove substantially between the area of the most proximal knuckle at the base of the little finger portion to the point of juncture and extending obliquely across the proximal palm portion to the distal palm portion adjacent the little finger portion thereby providing an adjustable fit in the fingers and palm areas of the glove.

2. The glove in claim 1 wherein said primary tensile force is aligned slightly left or right of said knuckle at the base of the little finger.

3. The glove in claim 1 wherein parts of said glove are made from extensible elastic materials.

4. The glove in claim 1 wherein said tensile forces are created by strapping means.

5. The glove in claim 4 wherein said strapping means have tensile forces created by extensible elastic strap segments.

6. The glove in claim 1 further including additional tensile forces aligned differently than said at least one primary tensile force.

7. The glove in claim 1 wherein said primary tensile force is aligned in a range of 45° to 75° away from the central axis of the forearm and originating at said point of juncture of the wrist and base of the thumb.

* * * * *